US008453382B2

(12) United States Patent
Kucer et al.

(10) Patent No.: US 8,453,382 B2
(45) Date of Patent: Jun. 4, 2013

(54) ENTRANCE CONTROL SYSTEM

(76) Inventors: Stephen Kucer, Montreal (CA); Nitai Friedman, Montreal (CA)

( * ) Notice: Subject to any disclaimer, the term of this patent is extended or adjusted under 35 U.S.C. 154(b) by 784 days.

(21) Appl. No.: 11/866,785

(22) Filed: Oct. 3, 2007

(65) Prior Publication Data

US 2009/0090596 A1 Apr. 9, 2009

(51) Int. Cl.
*E01F 13/00* (2006.01)

(52) U.S. Cl.
USPC ..... 49/49; 49/13; 49/68

(58) Field of Classification Search
USPC ..... 49/13, 45, 49, 68, 339–346
See application file for complete search history.

(56) References Cited

U.S. PATENT DOCUMENTS

| | | | | | |
|---|---|---|---|---|---|
| 949,384 | A | | 2/1910 | Stratton | |
| 1,688,709 | A | | 10/1928 | Hedley et al. | |
| 3,169,329 | A | * | 2/1965 | Powers | 49/35 |
| 3,386,202 | A | * | 6/1968 | Crews et al. | 49/35 |
| 3,478,467 | A | * | 11/1969 | May | 49/35 |
| 3,596,560 | A | | 8/1971 | Butterworth | |
| 3,606,698 | A | * | 9/1971 | Tanaka et al. | 49/35 |
| 3,645,042 | A | * | 2/1972 | Bolli | 49/326 |
| 3,742,647 | A | * | 7/1973 | Tomita | 49/35 |
| 4,026,069 | A | * | 5/1977 | Bohnett | 49/49 |
| 4,195,442 | A | * | 4/1980 | Keeling et al. | 49/35 |
| 4,290,230 | A | * | 9/1981 | t'Kint de Roodenbeke | 49/49 |
| 4,339,843 | A | * | 7/1982 | Burnett, Jr. | 16/62 |
| 4,375,735 | A | * | 3/1983 | Rhoads | 49/68 |
| 4,472,908 | A | * | 9/1984 | Wanzl et al. | 49/25 |
| 4,481,887 | A | * | 11/1984 | Urbano | 109/3 |
| 4,562,665 | A | | 1/1986 | Blackston | |
| 4,818,136 | A | | 4/1989 | Nasatka et al. | |
| 4,885,981 | A | * | 12/1989 | Roettger et al. | 92/59 |
| RE33,201 | E | | 4/1990 | Dickinson | |
| 4,981,199 | A | | 1/1991 | Tsai | |

(Continued)

FOREIGN PATENT DOCUMENTS

| | | | |
|---|---|---|---|
| CA | 2282036 | A1 | 9/2000 |
| DE | 4107953 | A1 * | 10/1991 |

(Continued)

OTHER PUBLICATIONS

Written Opinion of the Search Authority, PCT Application PCT/IB2010/000110, mailed Oct. 5, 2010.

(Continued)

*Primary Examiner* — Gregory J. Strimbu
(74) *Attorney, Agent, or Firm* — FSP LLC

(57) ABSTRACT

An entry control apparatus includes a pair of spaced barriers forming a pathway therebetween. The barriers are positioned adjacent a doorway to control ingress into and egress from a building or the like. An arm is pivotally mounted and extends across the pathway and permits free movement of people in one direction and selectively restricts movement in the other direction. A motion sensor is provided and a motion control system is associated with the sensor. The sensor and motion control system cooperate to selectively allow the arm to move to a normally open position for normal traffic in an approved direction. In the event a person approaches the apparatus, as if to exit, or move in the wrong direction through the pathway, the sensor detects the movement and effects operation of the motion control system that locks the arm against movement to prevent movement through the passageway. An alarm system can be provided to alert personnel that an unauthorized movement through the pathway may be underway.

3 Claims, 4 Drawing Sheets

U.S. PATENT DOCUMENTS

| | | | | | |
|---|---|---|---|---|---|
| 4,995,194 | A | * | 2/1991 | Schultze et al. | 49/32 |
| 5,072,543 | A | * | 12/1991 | Tetherton | 49/47 |
| 5,240,349 | A | * | 8/1993 | Kennedy et al. | 405/132 |
| 5,251,400 | A | * | 10/1993 | Schultze | 49/32 |
| 5,333,410 | A | * | 8/1994 | Tetherton | 49/35 |
| 5,615,520 | A | * | 4/1997 | McGuire | 49/237 |
| 6,065,246 | A | * | 5/2000 | Detassis | 49/47 |
| 6,185,867 | B1 | | 2/2001 | McGuire | |
| 6,425,820 | B1 | * | 7/2002 | Kennedy et al. | 454/169 |
| 6,594,954 | B1 | * | 7/2003 | Kennedy et al. | 49/340 |
| 7,845,115 | B2 | * | 12/2010 | Ponert et al. | 49/47 |
| 2007/0277439 | A1 | | 12/2007 | Ponert et al. | |

FOREIGN PATENT DOCUMENTS

| | | | | |
|---|---|---|---|---|
| EP | 0137568 | A2 | | 4/1985 |
| EP | 0643189 | A1 | | 3/1995 |
| WO | WO9323799 | A1 | | 11/1993 |
| WO | WO 9323799 | A1 | * | 11/1993 |

OTHER PUBLICATIONS

International Search Report, PCT Application PCT/IB2010/000110, mailed Oct. 5, 2010.

* cited by examiner

ENTRANCE CONTROL SYSTEM

BACKGROUND OF THE INVENTION

Entry and exit control devices are well known. They range from one-way turnstiles to swinging arms to automatic doors that can only be activated from one side or moved in only one direction.

One such device may be found in U.S. Pat. No. 6,185,867. This device uses a plurality of interconnected arms to control entry and exit.

The use of such entry/exit control devices can be beneficial particularly in a commercial or a security setting to prevent people from exiting an entry door say, for example, when shoplifting or entering after a store is closed while allowing patrons to exit. However, entry/exit control devices need to be free of impediment to the movement of patrons or other people substantially freely in an approved direction. Additionally, there may be a need from time to time for the movement control device to allow legitimate reverse use of an entry/exit, i.e., to use it as a temporary exit/entry. Many of the devices are not readily adaptable for such reverse use. For example, a turnstile will not allow for the use of an entry door to take shopping carts to the outside of the building or to provide other legitimate egress through the entry door. However, security can be comprised by providing an entry door that can be used for exit without control, allowing patrons to bypass security devices that alert workers of the possible theft of items.

To provide for proper security, the doors are typically designed to operate in only one direction precluding legitimate exit through an entry door. However, many stores do not use doors at an entry or exit. Further, by law, a door may be required to open out for emergency use. Current movement control devices tend to be mechanical and thus operable in only one mode. They cannot distinguish between legitimate and illegitimate use and can be characterized as "dumb".

Thus, there is a need for a movement control system for use at an entry/exit doorway that is an improvement over current control devices and that can distinguish between legitimate and illegitimate use of a doorway both for entry and exit.

SUMMARY OF THE INVENTION

The present invention involves the provision of a movement control apparatus usable adjacent a building or structure door or doorway entrance. The apparatus includes a pair of spaced apart side barriers forming a pathway. People are required to traverse the pathway to use the doorway in either direction of movement, in and out. The apparatus includes a gate arm extending into the pathway a substantial distance and being selectively movable between an open position and a closed position. The arm normally moves forward from the first or closed position to a second or open position in an unrestricted manner for legitimation forward traffic. The arm is operatively associated with a motion limiting system that is operable to return the arm from the second or open position to the first or closed position and selectively prevent movement in the reverse direction toward the open position if a person tries to traverse the pathway in a reverse direction. The motion limiting system includes an arm lock operable to selectively prevent forward movement when reverse movement into the pathway is attempted. A motion sensor is operably connected to the motion limiting system and capable of distinguishing motion of a person toward the arm and the doorway in the reverse direction. If reverse motion is detected toward the arm or the doorway, the motion sensor will provide a signal to the motion limiting system to lock the arm in a closed position or a partially closed position preventing both forward and reverse movement of the arm.

DETAILED DESCRIPTION OF THE DRAWINGS

Like numbers throughout the various Figures designate like and/or similar parts and/or construction.

DETAILED DESCRIPTION

Figure 1:
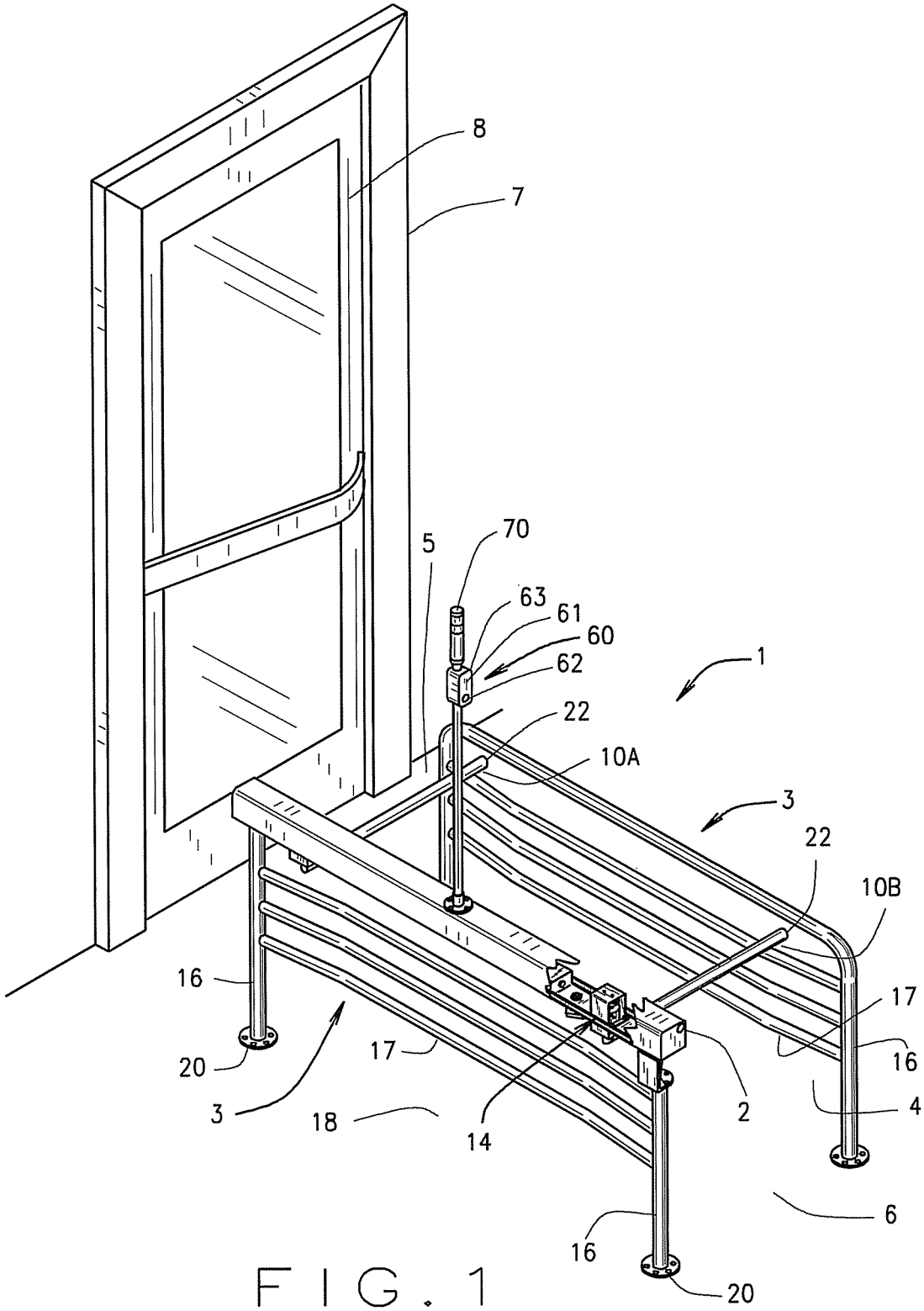
FIG. 1 is a perspective view of an entry control apparatus.

The reference numeral 1 designates generally a movement control apparatus operable to provide for free passage to people in one direction and restricted passage in the opposite direction at a point of entry or exit to a building or the like. The apparatus 1 is provided with an override device designated generally 2 that will allow reverse movement of people and/or items through the apparatus in a selective and controlled manner. The apparatus 1 includes a pair of spaced apart barriers 3 defining a pathway 4 therebetween. The apparatus 1 includes a normal pathway entrance 5 and a normal pathway exit 6. The apparatus 1 is positioned adjacent a doorway 7 that may be provided with a door 8 with the pathway 4 being in-line with the doorway 7. The relative position of the barriers 3 to the doorway 7 is such as to not allow use of the doorway without traversing the pathway 4. The apparatus 1 is provided with at least one gate arm 10 that is pivotal between a closed position and an open position. A sensor 12 is operably connected to a motion limiting system 14 to selectively prevent opening movement of an arm 10 upon detection of and distinguishing motion of a person toward the apparatus 1.

The barriers 3 may be any suitable barriers including walls of a building or the like in which the apparatus 1 is contained. As shown, the barriers 3 each include a pair of uprights 16 with the plurality of generally horizontal and vertical spaced rails 17 secured to the upright 16 and extending therebetween. The spaces between the rails 17 and between the bottom rail 17 and the floor 18 is small enough to prevent people from entering the pathway 4 through a barrier 3. The barriers 3 may be suitable secured to the floor 18 as for example with fasteners extending through flange mounts 20. Preferably, the rails 17 and uprights 16 are made of a tarnish resistant metal material for example, stainless steel or aluminum. A suitable total height of a barrier 3 is on the order of approximately 3 feet (1 meter). The width of the pathway 4 is preferably on the order of 3 to 4 feet (1-1.2 meters) and the length can be on the order of 6 to 8 feet (2-2.5 meters).

The apparatus 1 includes at least one arm 10 extending into the pathway 4 a substantial distance. Preferably, an arm 10 extends entirely across the pathway 4. While an arm 10 is shown extending the entire width of the pathway 4, it is to be understood that an arm 10 may be pivotally mounted on each of the barriers 3 and have their distal ends 22 positioned adjacent one another within the pathway 4. An arm 10 can be of a tubular metal construction and is also preferably made of a tarnish resistant metal in a preferred embodiment. In the illustrated structure, a pair of arms 10 are mounted to a barrier 3 with one being adjacent the entrance 5 and one being adjacent the exit 6 to enhance security. The arms 10 are pivotally mounted for movement in a forward direction, i.e., in a direction from the entrance 5 toward the exit 6, i.e., the direction of normal travel through the pathway 4. It is to be understood that the apparatus 1 may be used adjacent an exit door as well as an entrance door as described herein. The apparatus 1 controls movement of people so that they are compelled to move in only one direction through the pathway 4 during normal use of the pathway 4. The apparatus 1 may be configured to preclude exit through the entry door or entry through the exit door.

Figure 2:
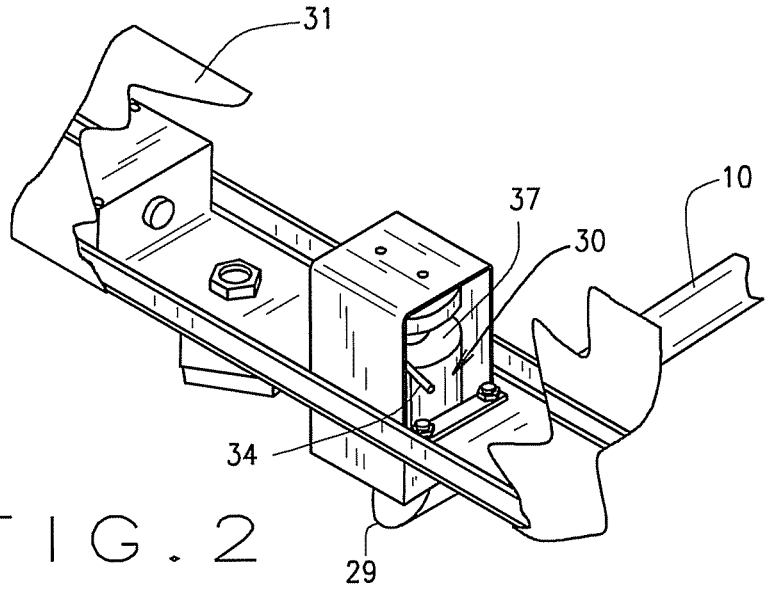
FIG. 2 is a an enlarged fragmentary perspective view of a portion of an arm and motion control device.
Figure 3:
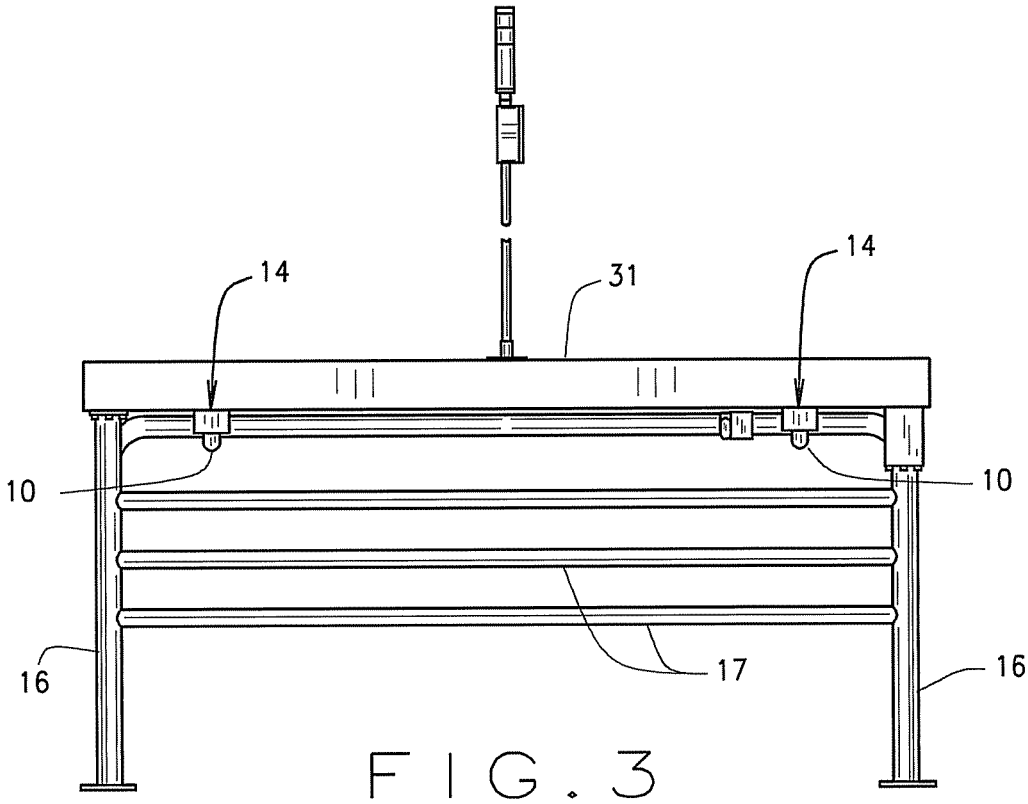
FIG. 3 is a side elevation view of the apparatus of FIG. 1.
Figure 4:
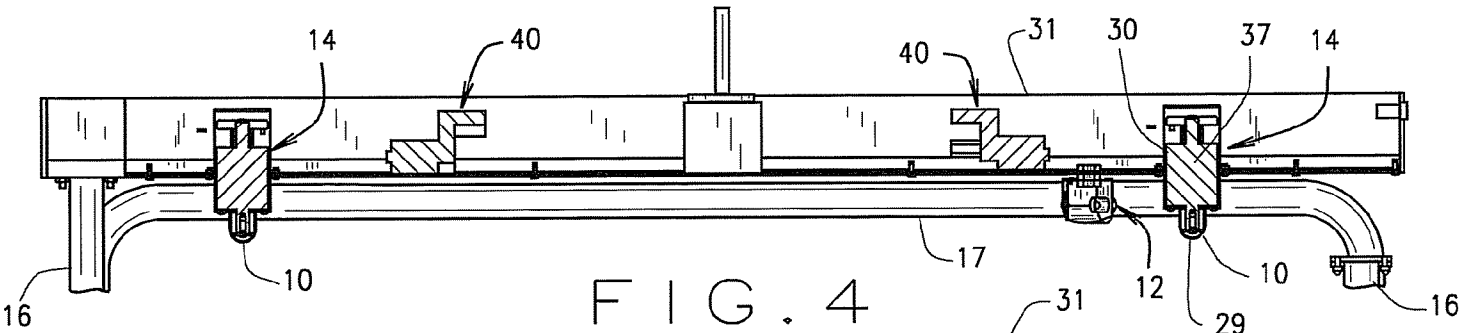
FIG. 4 is an enlarged partial fragmentary view of an upper portion of a barrier and a pair of motion control devices.
Figure 5:
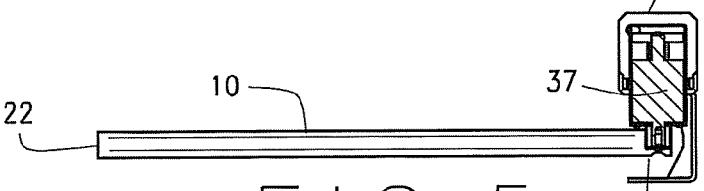
FIG. 5 is an enlarged front fragmentary view of an arm and motion control device.
Figure 7:
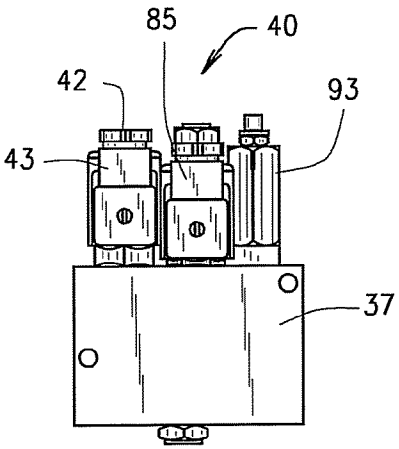
FIG. 7 is a side view of an arm motion control device and associated flow control valve.
Figure 6:
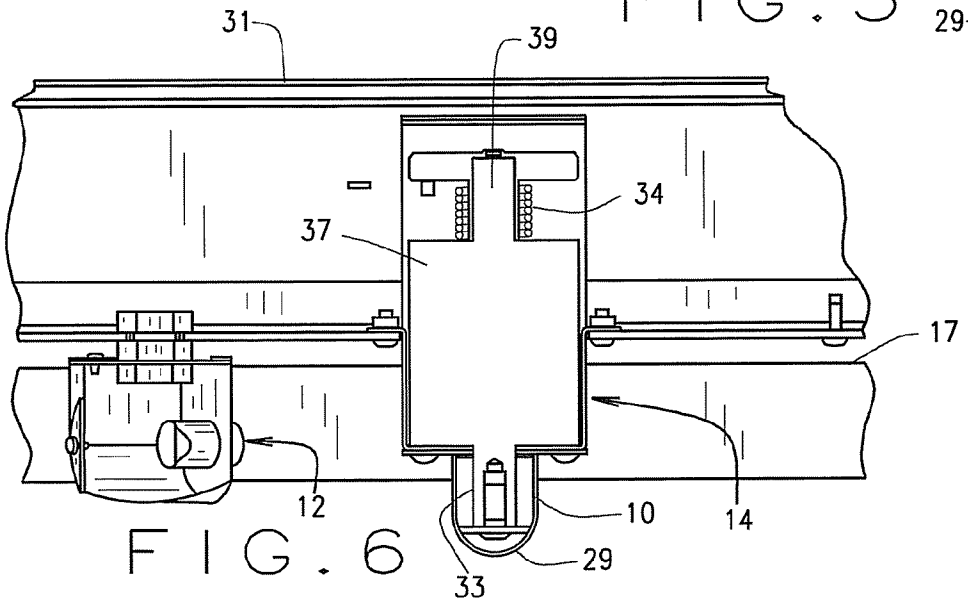
FIG. 6 is an enlarged side fragmentary view of an arm motion control device.

An arm 10 is preferably a tubular metal member pivotally mounted on a respective barrier 3. As shown, the arms 10 are mounted on one barrier 3 on a top rail 17 thereof. In a preferred embodiment, as best seen in FIGS. 1, 4, 6, an arm 10 has a proximal end 29 mounted to a respective motion limiting device designated generally 30 which has a portion thereof shielded in a housing 31. The arm 10 is mounted on an underside of a portion of the device 30 as on a pivot shaft 33 (FIG. 6). An arm return device 34 as best seen in FIGS. 2, 6, is provided. The return device 34 can be a torsion spring which can both resist opening movement and induce closing movement of an arm 10. As shown, the return device 34 is mounted on a hydraulic actuator 37 portion of the motion limiting system 30. The actuator 37 has shafts 33, 39 on opposite ends thereof with the arm 10 being mounted on the shaft 33 and the return device 34 being mounted on the shaft 39. Preferably, the actuator 37 is a vane type hydraulic actuator that will pump fluid in either direction of rotation, i.e., for forward movement of the arm 10 or reverse movement of the arm 10. The motion limiting system 14 also includes a valve arrangement 40 that is in flow communication with the actuator 37 and is operable to allow free flow of fluid during normal operation of the arm 10 in the forward direction, i.e., from the arm closed position to the arm open position. Once the arm 10 is moved to an open position a user may release the arm and the return device 34 will urge the arm 10 to move in a reverse direction toward its closed position. The speed of the closing movement of an arm 10 can be controlled by the valve 42 during normal operation. Preferably, the valve 42 can be selectively closed, as hereinafter described. Preferably, the valve 42 is a solenoid operated check valve wherein the solenoid 43 is operable to move the valve element (not shown) to a completely closed condition preventing movement of the actuator 37 and its respective arm 10 upon receipt by the solenoid 43 of a control signal. The motion limiting system 14 can also include a stop device (not shown) to physically limit the amount of closing and opening movement of an arm 10. For example, the upright 16 may be used to limit movement of an arm 10 in the forward direction. Preferably, a stop is provided to prevent movement of an arm 10 rearward of the closed position.

A motion sensor designated generally 12 is provided and is operable to sense both the presence of a person and the direction of movement of the person. If the motion of a person is other than away from the arm 10, this is sensed by the sensor 12 which is operable to provide a signal from a programmed control device to the motion limiting system 14 to selectively prevent the arm 10 from being moved in a forward position. The sensor 12, with its associated software, is operable to allow a person to move normally through the pathway 4 in the forward direction. Suitable sensors 12 are available from Massa. Upon detecting movement of a person toward an arm 10, the sensor 12 sends a signal to the solenoid 43 to move the valve 42 to a closed position. When the valve 42 is closed, the actuator 37 is locked against forward rotation, preventing the arm 10 from moving to an open or more open position, thus preventing a person from approaching the exit of the apparatus 1 and moving through in an unauthorized direction without permission. The arm 10 can be moved to a more closed position, but not a more open position. The sensor 12 is also operable to actuate an alert system in a preferred embodiment.

The alert system, designated generally 60, is operably connected to the sensor 12 which sends a signal to the alert system 60 to actuate the same in the event unauthorized movement is detected adjacent an arm 10. A sensor 12 is preferably associated with each arm 10 so that both arms can lock if there is unauthorized motion. The alert system 60 can include a speaker operably connected to a message playback device 61 such that activation of the playback device 61 will effect playback of a message through the speaker 62 contained in a housing 63. The playback message may inform a person that they have moved too close to an arm 10 in an unauthorized direction, that the arm 10 is now locked and will prevent movement through the pathway 4 and that the person is to move to another location. The sensor 12 may also be operable to detect movement away from the arm and automatically reset the motion limiting system allowing people to once again enter through the pathway 4. The apparatus 1 may be configured to also require an authorized person to reset the apparatus 1. In addition to the audio alert, a visual alert device designated generally 70, in the form of a light or flashing light may also be provided to alert an authorized person or other personnel that an unauthorized exit attempt has been made. Warning signs (not shown) may also be provided on the apparatus 1 to alert people to the security system to act as a further deterrent.

Figure 8:
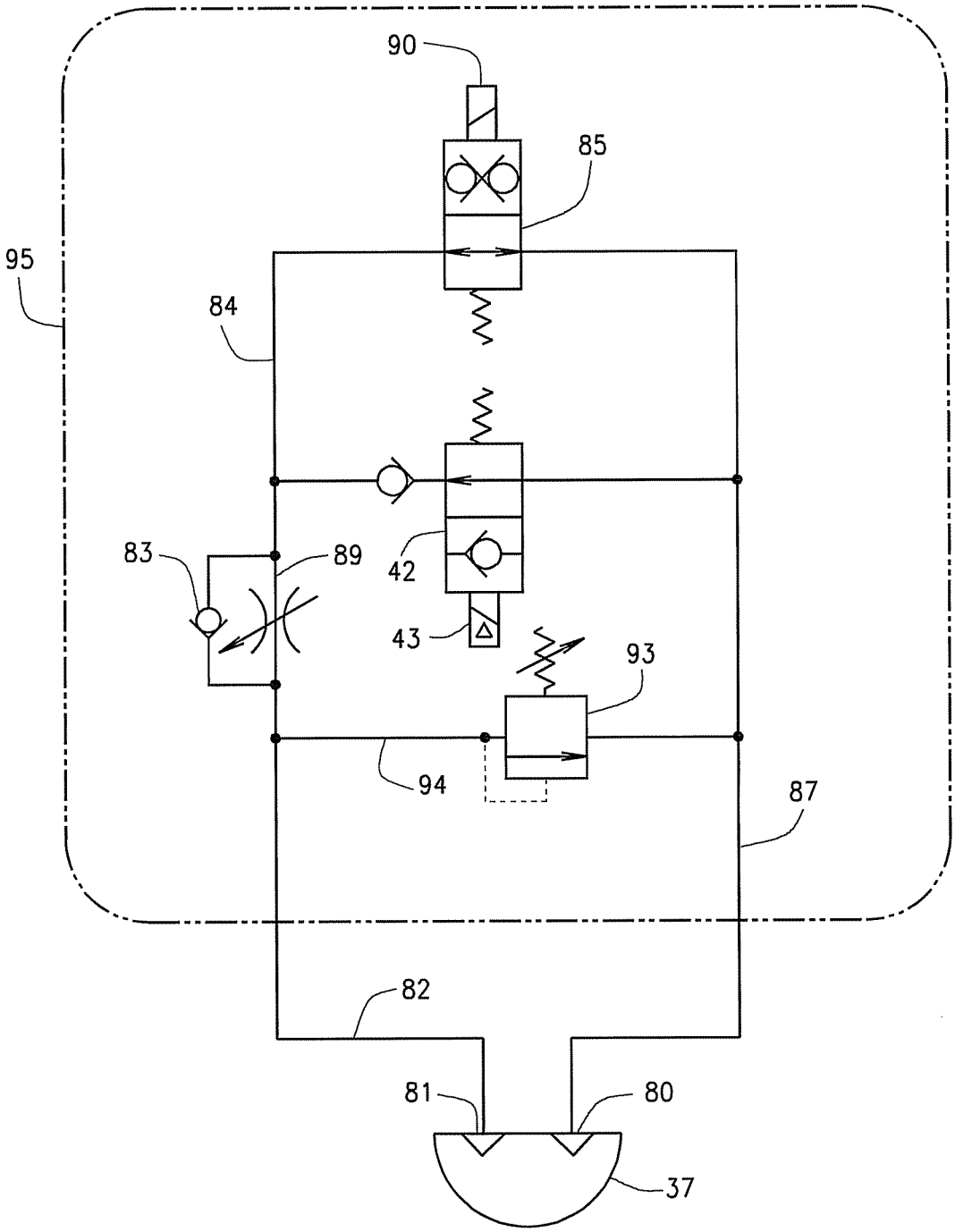
FIG. 8 is a schematic of a hydraulic system.

FIG. 8 illustrates a schematic of the fluid flow and actuator 37 control system. The actuator 37 has a pair of ports 80, 81. The port 80 is operable for outflow when the arm 10 is moving to a closed position as described above. The port 81 is operable to permit outflow of fluid when the arm 10 is moving to an open position as described above. During normal opening movement of the arm 10, the fluid flow goes through the conduit 82 and is substantially unimpeded through a check valve 83 to and through conduit 84 to a solenoid actuated valve 85. The valve 85 can be in the form of a double check valve. The fluid then returns to the actuator 37 through the conduit 87 back to port 80 and the actuator 37 for loop flow. Thus, the opening movement of the arm 10 is substantially unimpeded during normal approved or authorized use of apparatus 1. During normal closing movement of an arm 10, the flow of fluid is out port 80 through the conduit 87 back to the actuator through the conduit 82 and a flow control valve 89. The flow control valve 89 is preferably a variable flow control valve which can adjustably control the closing speed of the arm 10 under the influence of the arm return device 34. During arm return movement, the fluid from actuator 37 can flow through the valves 42 and/or 85 depending upon their operating configuration. Should a signal be received from the sensor 12 and the alert system 60 controller, the valves 42 and 85 move to a closed configuration to prevent flow from the conduit 87 to either the conduit 84 or conduit 82. By actuation of the respective solenoids 43, 90. A pressure relief valve 93 may be provided to allow for selective flow communication from the conduit 87 to the conduit 82 in the event an overload condition is applied to an arm 10. When a predetermined pressure in the system is applied to the relief valve 93, due to excessive force applied to an arm 10, the valve 93 will move to an open position, which may be variable, to allow flow from port 80 to port 81 through conduits 82, 87, 94. Preferably, a large force would be required to open valve 93 to permit movement of the arm 10 to a closed position when valves 85, 42 are closed to flow from conduit 87 to conduit 82. The relief valve 93 prevents overloading its arm 10 and damage thereto. The components may be housed in a housing 95 shown schematically in FIG. 8.

The apparatus 1 described above was generally described in a single arm configuration. As seen in FIG. 1, a multiple arm 10 configuration is provided. Both arms 10, the entry end arm 10A and the exit arm 10B may have similar motion limiting systems 14 and motion sensors 12, both utilizing the alarms 60, 70 as described above. The use of multiple arms 10 adds an extra level of security should someone bypass the first arm 10 in an attempt to leave the facility in an unauthorized direction. In a preferred embodiment of a multiple arm apparatus, the arms operate mechanically independent of one another.

An override system may be provided to allow authorized personnel to move through the apparatus 1 in the unauthorized direction. This may be desirable, for example, when moving items out of the facility, for example, shopping carts. One form of override 2, can be in the form of a key switch which will deactivate the sensor 12 from being able to send a signal to the solenoid 43 allowing the valve 42 to work normally and allow a person who is authorized to move the arm or arms 10 to an open position. The override 2 may be simply a switch installed in the circuit powering the sensor 12 or prevent a signal from being sent to the solenoid 43 allowing the valve 42 to move to a normally open position or remain in a normally open position.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A gate system comprising:

a pair of sides forming a pathway;

at least one moveable gate configured to block the pathway;

a motion limiting system allows the gate to operate in a forward motion mode in which the gate yields to allow forward motion of a first person moving through the pathway in a forward direction from an ingress area to the pathway to an egress area of the pathway, a motion sensor coupled to the motion limiting system, the motion sensor mounted between the ingress area and the gate and directed to detect motion of a second person in a direction opposite the forward direction and toward the gate, and to detect a presence of the first person between the ingress area and the gate, the motion sensor configured to output a signal to the motion limiting system indicative of the motion of the second person in the direction opposite the forward direction and toward the gate; and the motion limiting system locks the gate against the forward motion of the first person in the forward direction and against the motion of the second person in the direction opposite the forward direction and toward the gate when the signal from the motion sensor indicating the motion of the second person in the direction opposite the forward direction and toward the gate is received by the motion limiting system, and the gate is being operated in the forward motion mode.

2. The gate system of claim 1, wherein the gate is an arm mounted on a pivot and the pathway is between three and four feet wide.

3. The gate system of claim 1, wherein the motion limiting system is configured to unlock the gate to allow the forward motion of the first person through the pathway if the motion sensor provides a signal indicating the motion of the second person in the direction opposite the forward direction and toward the gate has ended.

* * * * *